United States Patent [19]

Matsumura

[11] Patent Number: 4,627,403

[45] Date of Patent: Dec. 9, 1986

[54] FUEL INJECTION APPARATUS

[76] Inventor: Osamu Matsumura, No. 402, 1-29-9, Kamiochiai, Shinjuku, Tokyo, Japan

[21] Appl. No.: 668,143

[22] Filed: Nov. 5, 1984

[30] Foreign Application Priority Data

Dec. 27, 1983 [JP] Japan ..... 58-248659
Dec. 27, 1983 [JP] Japan ..... 58-248660

[51] Int. Cl.[4] ..... F02M 39/00
[52] U.S. Cl. ..... 123/447; 123/458
[58] Field of Search ..... 123/447, 458, 299, 300, 123/514

[56] References Cited

U.S. PATENT DOCUMENTS 3,575,145 4/1971 Steiger ..... 123/458
3,587,547 6/1971 Hussey ..... 123/447
3,827,409 8/1974 O'Neill ..... 123/447
4,440,134 4/1984 Nakao ..... 123/458
4,462,368 7/1984 Funada ..... 123/447

*Primary Examiner*—Carl Stuart Miller
*Attorney, Agent, or Firm*—McDougall, Hersh & Scott

[57] ABSTRACT

Fuel is held under high pressure by an accumulator which is connected with injecting nozzles by respective fuel pipes. The fuel pipes are each provided with a timing control valve and a quantity control valve, and these valves are controlled by an electric control apparatus. The control apparatus controls the timing valve in response to the angular position of the engine and controls the quantity control valve in response to the engine load, whereby the injecting nozzle injects the proper quantity of fuel at the proper moment.

9 Claims, 12 Drawing Figures

FUEL INJECTION APPARATUS

BACKGROUND OF THE INVENTION

1. Field of the Invention

This invention generally relates to a fuel injection apparatus for internal combustion engines, and more particularly, this invention is directed, but not limited, to a fuel injection apparatus for compression ignition engines or Diesel engines.

2. Description of Prior Art

In a compression ignition engine or a Diesel engine, air in a cylinder is compressed by a piston in order to raise temperature of the air. Fuel is then injected through an injecting nozzle to cause spontaneous ignition for the combustion of the fuel to generate output force. The fuel is compressed and supplied to the fuel injection nozzle by means of a fuel injection pump. Accordingly, the conventional Diesel engine is provided with a fuel injection pump, the cam shaft of which has a timer for controlling the timing of the injection. The timer, in fact, controls the angular phase of the cam shaft. Furthermore, the injection pump has a control rack for controlling the quantity of the fuel supplied at one time, and the control rack is controlled by a mechanical governor in response to the engine load.

Accordingly, the conventional fuel injection apparatus for a Diesel engine includes a fuel injection pump, a mechanical governor, and a timer, and these components all have very complex mechanical structures which makes the fuel injection apparatus very expensive. Furthermore, these complex apparatus require highly skilled maintenance. Moreover, these mechanically complex structures make it impossible to control the fuel injection apparatus electrically.

OBJECT OF THE DISCLOSURE

One object of this invention is to provide a simple and inexpensive injection apparatus.

Another object of this invention is to provide a fuel injection appatatus, that does not require highly skilled maintenance work to be performed.

A further object of this invention is to provide a fuel injection apparatus which is completely electrically controlled.

In accordance with one aspect of this invention, there is provided a fuel injection apparatus wherein fuel under pressure is supplied to an injecting nozzle to inject a mist of fuel, the injection apparatus comprising;

(a) an accumulator for holding the fuel under pressure;

(b) a timing control valve for controlling the timing of the supply of the fuel from the accumulator to the injecting nozzle;

(c) a quantity control valve for controlling the amount of fuel injected by the injecting nozzle at one time; and (d) an electric control means for controlling the timing control valve and the quantity control valve in response to the number of revolutions and the engine load.

The above, and other objects, features and advantage of the invention will be apparent from the following detailed descriptions of an illustrative embodiments which are to be read in conjunction with the accompanying drawings.

DETAILED DESCRIPTION OF PREFERRED EMBODIMENT

Figure 1:
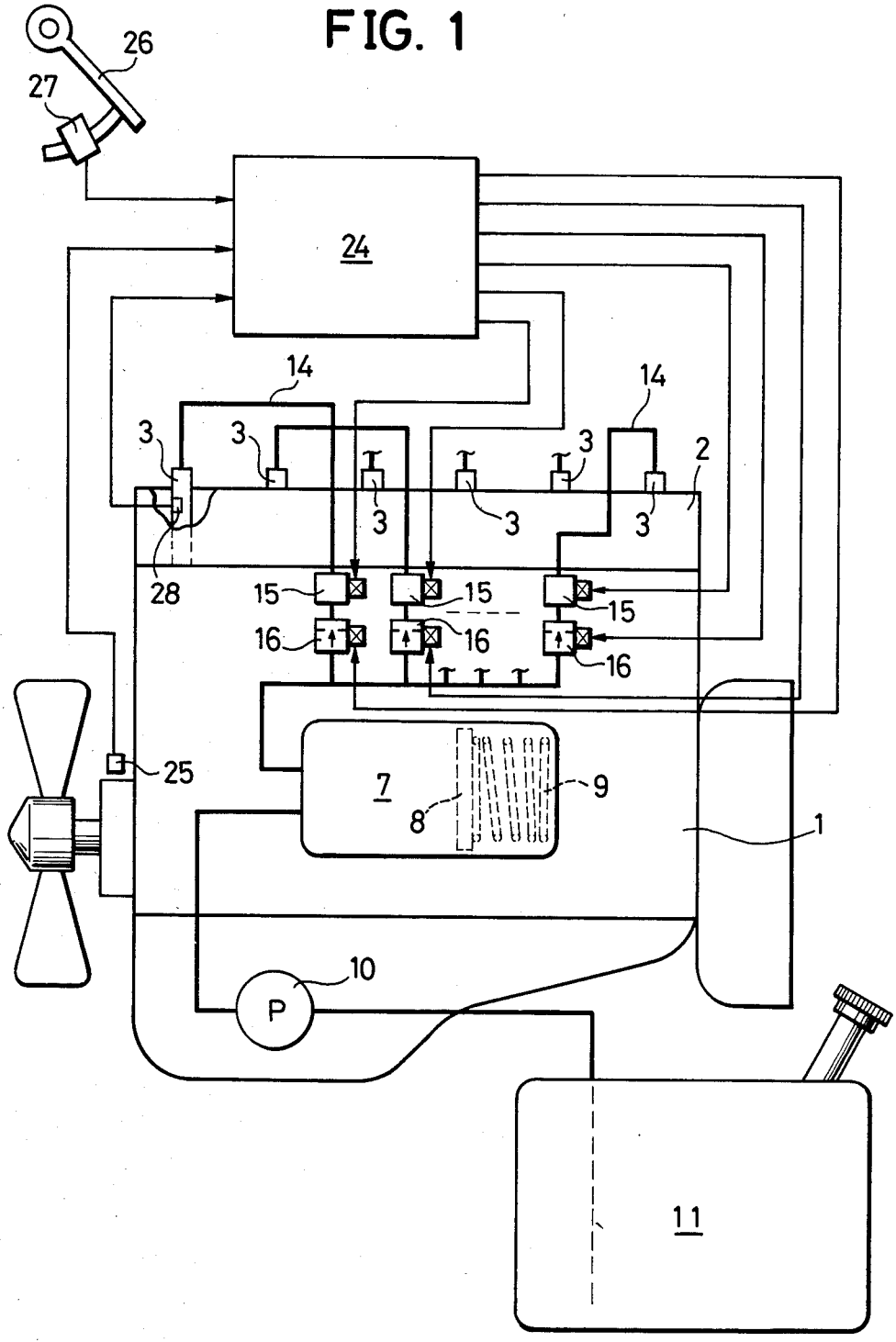
FIG. 1 is side view of a Diesel engine with a fuel injection apparatus according to the first embodiment of this invention.
Figure 2:
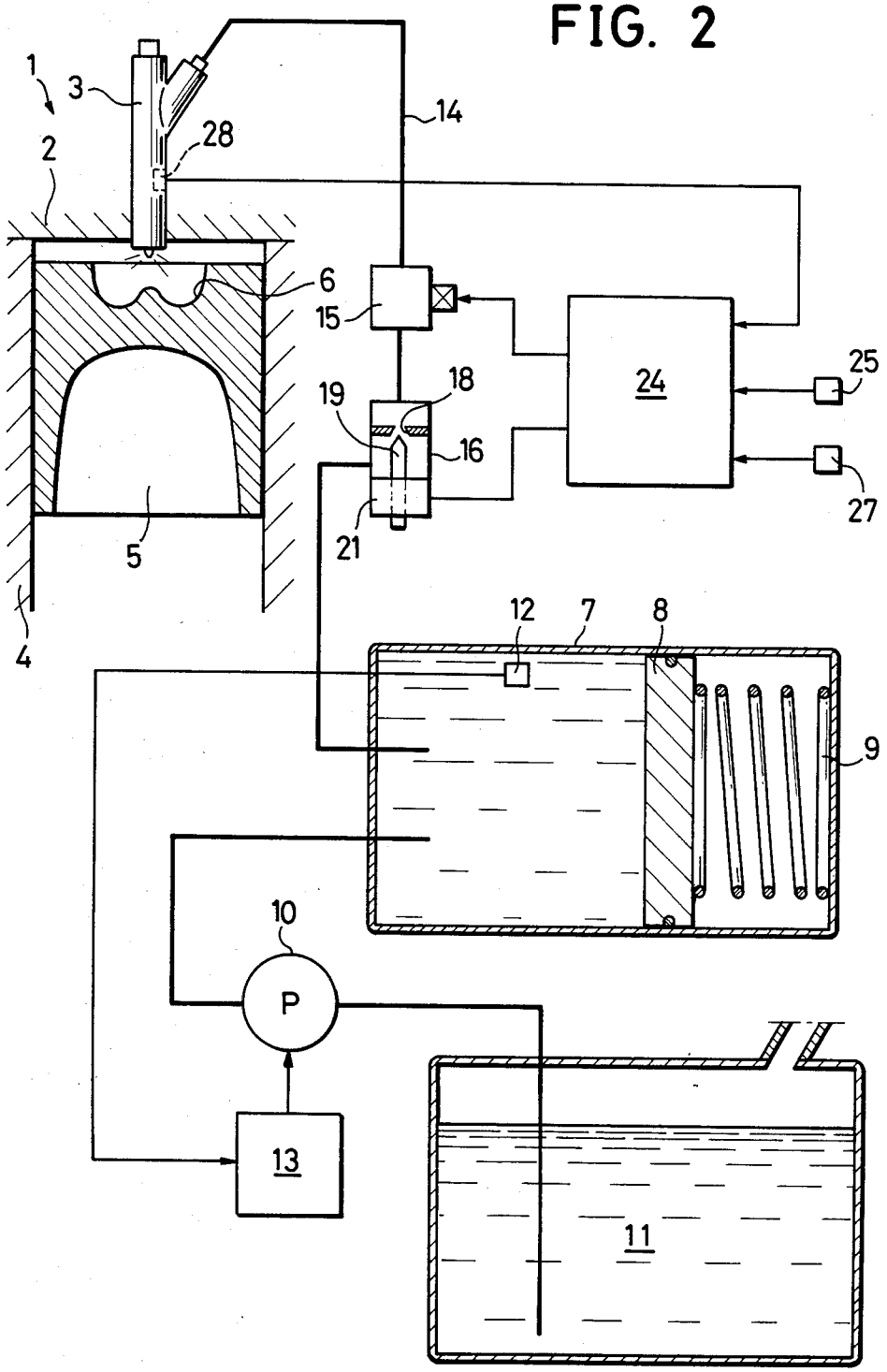
FIG. 2 is a block diagram of the fuel injection apparatus shown in FIG. 1.

FIG. 1 and FIG. 2 show a Diesel engine 1 with a fuel injection apparatus according to the first embodiment of this invention. The cylinder head 2 of the engine 1 has injecting nozzles 3 in respective cylinders. When the engine 1 has six cylinders, six injecting nozzles 3 are provided. The top end of the nozzle 3 injects the fuel into a combustion chamber 6 or combustion recess formed on the top of a piston 5. The piston 5 is received in the cylinder 4 as shown in FIG. 2.

The engine 1 has an accumulator 7 on the side, and the accumulator 7 is comprised of a high pressure shell or tank and receives a piston 8, which is pushed by a coil spring 9. A chamber opposite to the spring chamber relative to the piston 8 comprises a space for fuel which is in turn held under high pressure. Fuel is supplied to the fuel space by a high pressure feed pump 10 from a fuel tank 11. The feed pump 10 is controlled by a controller 13 which is connected with a pressure sensor 12 which detects the pressure of the fuel in the accumulator 7.

Figure 3:
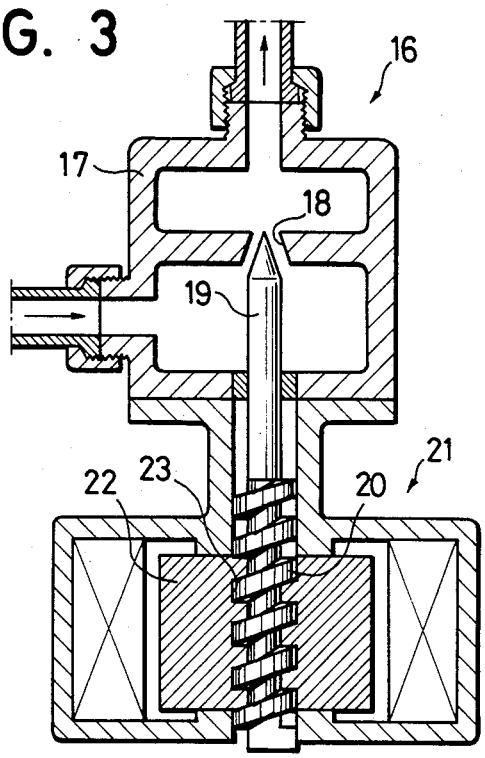
FIG. 3 is a cross section of a quantity control valve of the fuel injection apparatus.

The accumulator 7 is connected with the injecting nozzles 3 provided with respective cylinder 4 of the engine 1 by fuel pipes 14. Further, the fuel pipes 14 are connected with timing valves 15 or magnetic valves and quantity control valves 16, in response to the respective injecting nozzles 3 of the cylinders 4 as shown in FIG. 1 and FIG. 2. The quantity control valve 16 is made up of a throttle valve which is provided with a throttle opening 18 formed on a dividing wall of the casing 17 and a needle 19 facing the throttle opening 18 as shown in FIG. 3. The needle 19 is connected with the top end of the screw 20 which is prevented from rotation by a stopper (not shown) and is threaded with a female screw 23 of the rotor 22 of a stepping motor 21.

A micro processor 24 is wired to the magnetic timing valve 15 and throttle valve or quantity control valve 16 as a means of electrically controlling the valves 15 and 16. The input terminals of the micro processor 24 are connected to a revolution detecting sensor 25 and a load sensor or an accel sensor 27 which detect the revolution of the engine 1 and the rotational angle of the accel pedal 26 respectively. Further, the micro processor 24 is connected with a position sensor 28 on the fuel injecting nozzle 3 for the purpose of detecting the position of the nozzle needles of the respective injecting nozzles 3.

Next will be described the operation of this fuel injection apparatus of the engine 1. The feed pump 10 sucks the fuel from the fuel tank 11 and supplies it to the accumulator 7. The fuel in the accumulator 7 is pushed by a coil spring 9 through the piston 8, and hence is held under very high pressure. The pressure of the fuel in the accumulator 7 is detected by the pressure sensor 12, and the out-put signals of the sensor 12 are supplied to the controller 13 which controls the number of revolutions or strokes of the fuel pump 10 and thereby maintains the pressure of the fuel in the accumulator 7 at a constant level.

Figure 4:
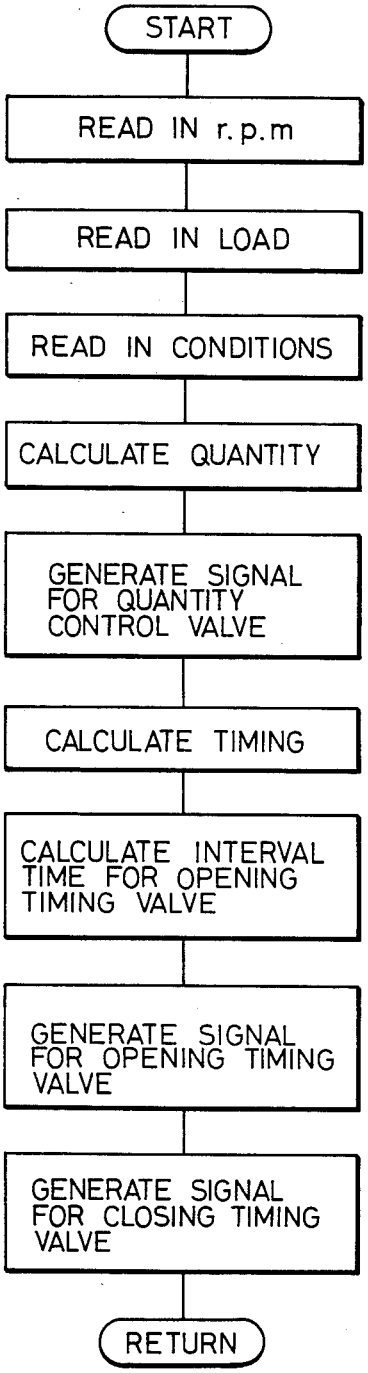
FIG. 4 is a flow chart of the operation of the fuel injection apparatus.

The fuel under high pressure in the accumulator 7 is supplied to the injecting nozzle 3 through the throttle valve 16 and the timing valve 15 in order to inject fuel into the cylinder 4 of the engine 1 when the timing valve 15 is opened. The timing of the opening and closing of the valve 15 is controlled by the control signal generated from the micro processor 24 in response to the detecting signal of the revolution detecting sensor 25 which detects the angular position of a crank shaft of the engine 1, as shown in FIG. 4. The sensor 25 detects the crank angle of the engine 1 and the micro processor 24 controls the opening and closing of the timing valve 15 in such a way as to cause the accurate injection of the fuel into the cylinder 4.

Information concerning the number of revolutions of the engine 1 is supplied to the micro processor 24 by means of the detecting sensor 25. Thus, the micro processor 24 can advance or delay the timing of the opening of the magnetic valve 15 in accordance with the conditions which are previously held in the memory of the processor 24, in response to a change in the number of revolutions of the engine 1. When the number of revolutions increases, the opening timing of the valve 15 is speeded up, and when the number of revolutions is decreased, the opening timing is delayed. These operations mean that the magnetic valve 15 and the micro processor 24 perform timer functions.

Next, the quantity of the fuel injected at one time by the nozzle 3 is controlled by the throttle valve 16. Such control is performed, as shown in FIG. 4, in response to the detection of the angle of the accel pedal 26 or the engine load, by the accel sensor 27 which supplies detecting signals to the micro processor 24. The micro processor 24 drives the stepping motor 21 by means of a drive circuit (not shown) in response to the signals out-put by the sensor 27. When the stepping motor 21 is driven, the rotor 22 rotates at a certain angle, and the rotor 22 displaces the screw 20, which engages the female screw of the rotor 22, in the axial direction because the screw 20 is prevented from rotation. In accordance with the axial movement of the screw 20, the needle 19 moves in the same direction to change the effective area of the throttle opening 18. The changing of the area of the throttle opening 18 makes it possible to change the quantity of the fuel injected at one time. Accordingly, the micro processor 24 and the throttle valve 16 perform the function of the governor.

As mentioned above, according to this fuel injection apparatus, the magnetic valve 15, connected with the fuel pipe 14, controls the injection timing, and the throttle valve 16 also connected with the fuel pipe 14, controls the quantity of fuel injected at one time. The quantity of fuel injected at one time is in proportion to the area of the portion denoted by oblique lines in FIG. 5 which shows the injection pattern of this apparatus. In this graph of the pattern, the horizontal axis represents the time or crank angle of the engine 1, and the vertical axis represents the quantity of fuel per unit time or the effective area of the throttle opening 18 of the quantity control valve 16.

Figure 5:
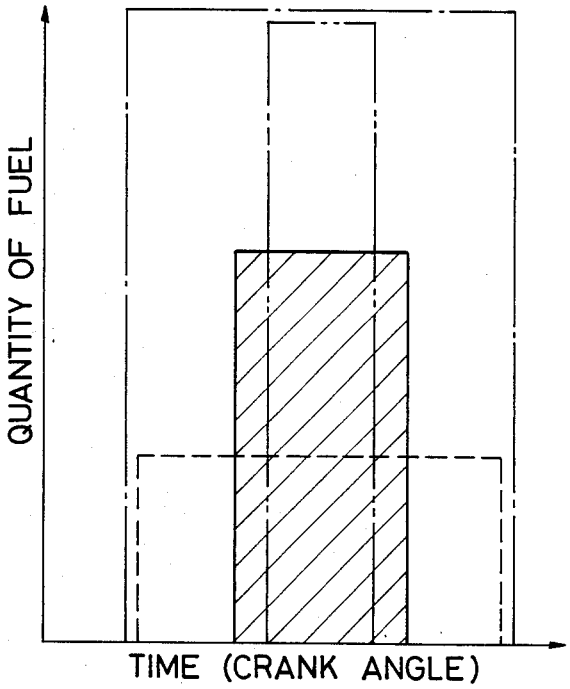
FIG. 5 is a graph of the injecting pattern of the fuel injecting apparatus.

The pattern shwon by the solid line in FIG. 5 is the pattern of standard injection. The pattern shown by the two dash dotted line is obtained when the effective area of the throttle opening 18 is large and the interval of time for opening the timing valve 15 is short. In contrast, a small area of throttle opening 18 and a large interval of opening brings a pattern shown by the dotted line in FIG. 5. Further, the pattern shown in the single dash dotted line means that a large quantity of fuel is injected to generate very large torque.

In the above mentioned fuel injection apparatus, the accumulator 7 with a coil spring 9 inside may be replaced by an accumulator with compressed gas inside. Furthermore, the micro processor 24 may be replaced by a controller consising of discrete electronic circuits. Moreover, the connection between the magnetic valve 15 and the throttle vlave 16 may be hooked up in the opposite way.

Figure 6:
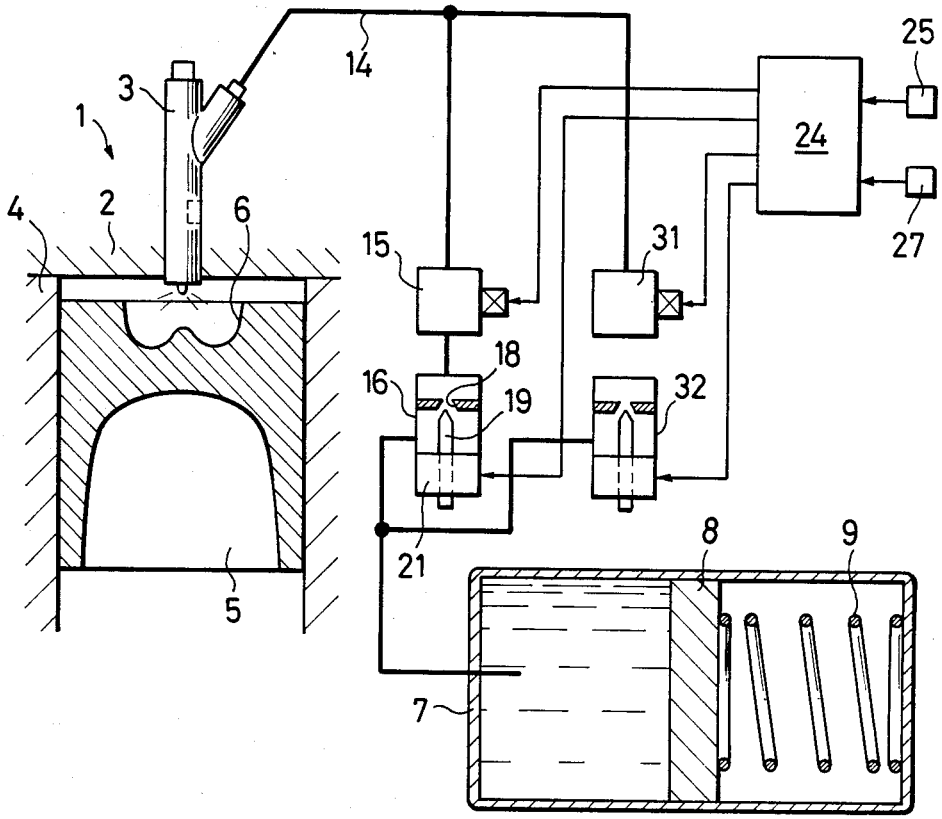
FIG. 6 is a block diagram of a fuel injection apparatus according to a second embodiment of this invention.

Next will be described a second embodiment of this invention with reference to FIG. 6 and FIG. 7. In this second embodiment and the following embodiments, corresponding parts will be denoted by the same reference numerals as those in the first embodiment and the descriptions for the same composition as that of the first embodiment will be omitted.

The salient feature of this embodiment is that the injection apparatus further includes another assembly of timing valve 31 and throttle valve 32 for the pilot injection. Valves 31 and 32 are connected in series with each other, and the assembly of valves 31 and 32 is connected with the assembly of valves 15 and 16, in parallel. The micro processor 24 controls the magnetic valve 31 to control the timing of the pilot injection and the micro processor 24 controls the throttle valve 32 in order to control the quantity of fuel in the pilot injection.

Figure 7:
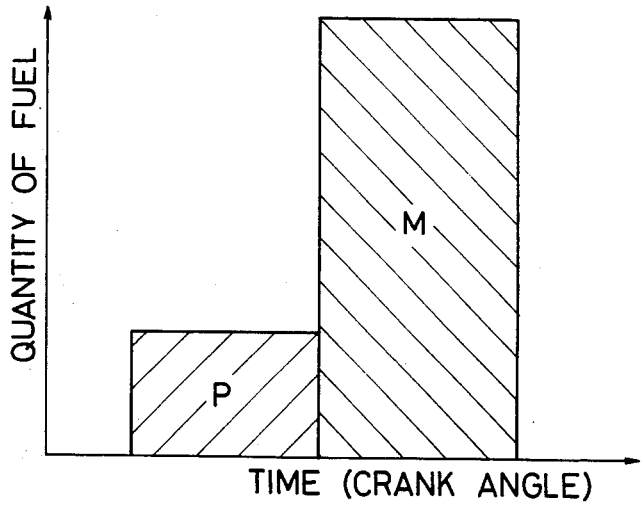
FIG. 7 is a graph of the injecting pattern of the fuel injection apparatus shown in FIG. 6.

FIG. 7 shows an example of an injecting pattern, in which the portion denoted by "P" shows the pattern of pilot injection and the portion denoted by "M" shows the pattern of main or primary injection. The pilot injection causes a stable combustion, and decreases the nitrogen oxide contained in the exhaust gas of engine 1.

Figure 8:
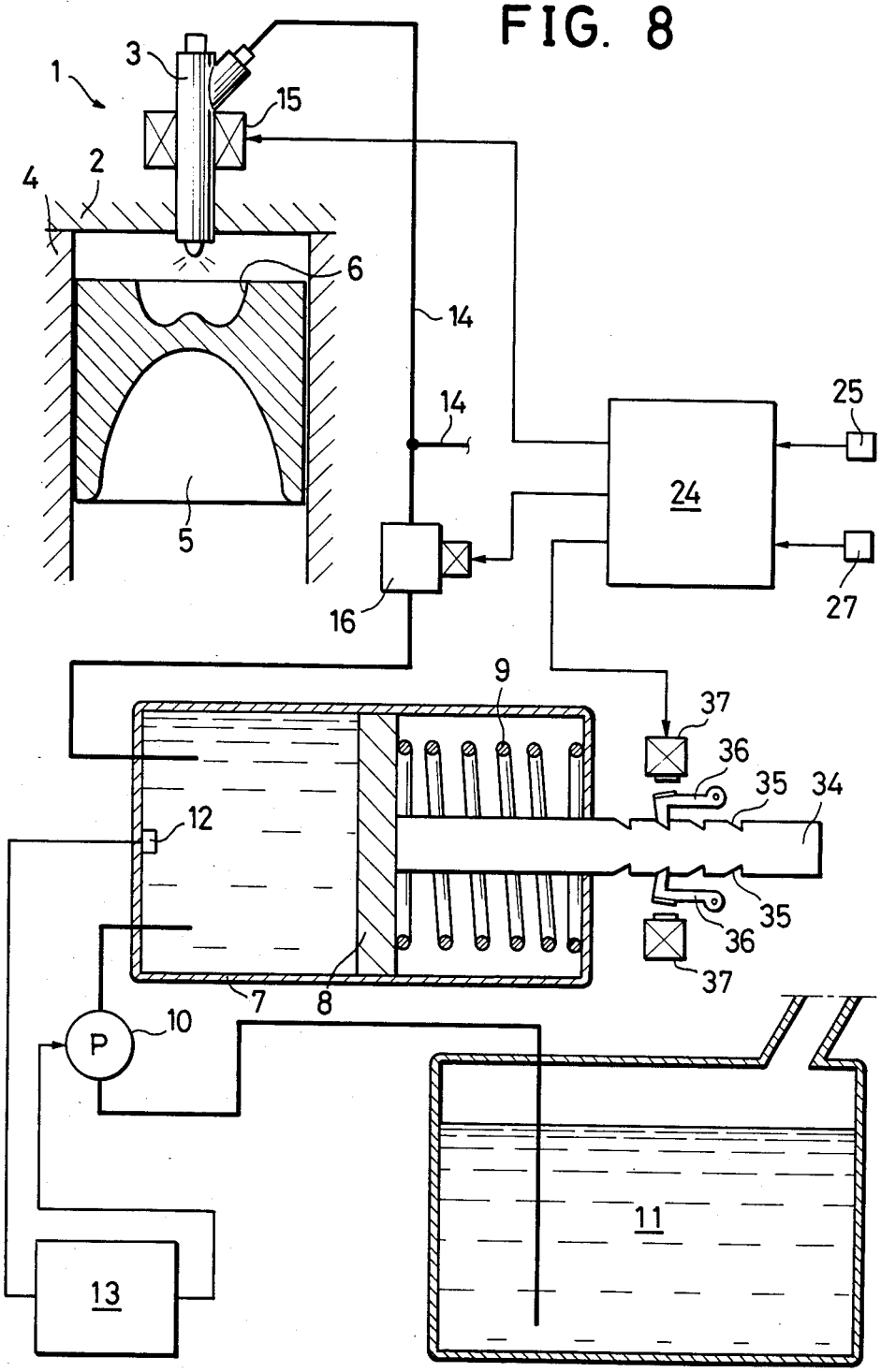
FIG. 8 is a block diagram of a fuel injection apparatus according to a third embodiment of this invention.

FIG. 8 shows a third embodiment of this invention, and in this embodiment the timing valve or magnetic valve 15 is coupled with its respective injecting nozzle 3. Namely, every injecting nozzle 3 has a magnetic coil 15 which is controlled by the micro processor 24 through the drive circuit (not shown) to displace the nozzle needle of the nozzle 3. Hence the timing control operation for the injection is performed by the injection nozzle 3 itself.

Another feature of this embodiment is that the throttle valve or quantity control valve 16 is commonly used for all the nozzles 3. The out-put mouth of the control valve 16 is connected to each injecting nozzle 3 through diverging fuel pipes 14. Accordingly, the number of quantity control valves 16 is minimized and a single valve 16 can control the injections of every injecting nozzle 3.

Another feature of this embodiment is that the accumulator 7 has a structure to prevent leakage of fuel. A rod 34 connected with the piston 8 is projected backwards and has plural recesses 35 thereon. Latch members 36 are arranged around the rod 34 in a manner allowing free rotation to permit engagement of the recess 35. The latch 36 is rotated and disengaged from the recess 35 when an electric magnet 37 is energized.

When the engine 1 operates, the micro processor 24 supplies electric current to the coils of the magnets 37 and attracts the latch 36 to disengage the latch 36 from the recess 35. Accordingly, the rod 34 becomes free and movable, and the fuel in the accumulator 7 is pressed by the coil spring 9 through the piston 8. Hence the fuel is held under very high pressure.

On the contrary, when the engine 1 is stopped, the micro processor 24 generates a control signal to cease the supply of electric current to the magnet 37. Therefore, the latch 36 rotates by the return spring (not shown) to engage the latch 36 and the recess 35. Accordingly, the force of the coil spring 9 is received by the latch 36, and the piston 8 does not compress the fuel in the accumulator 7. The leakage of fuel is thereby prevented, even if the engine 1 is not operated for long period of time, and stable injection can be performed when the engine 1 is next operated.

Figure 9:
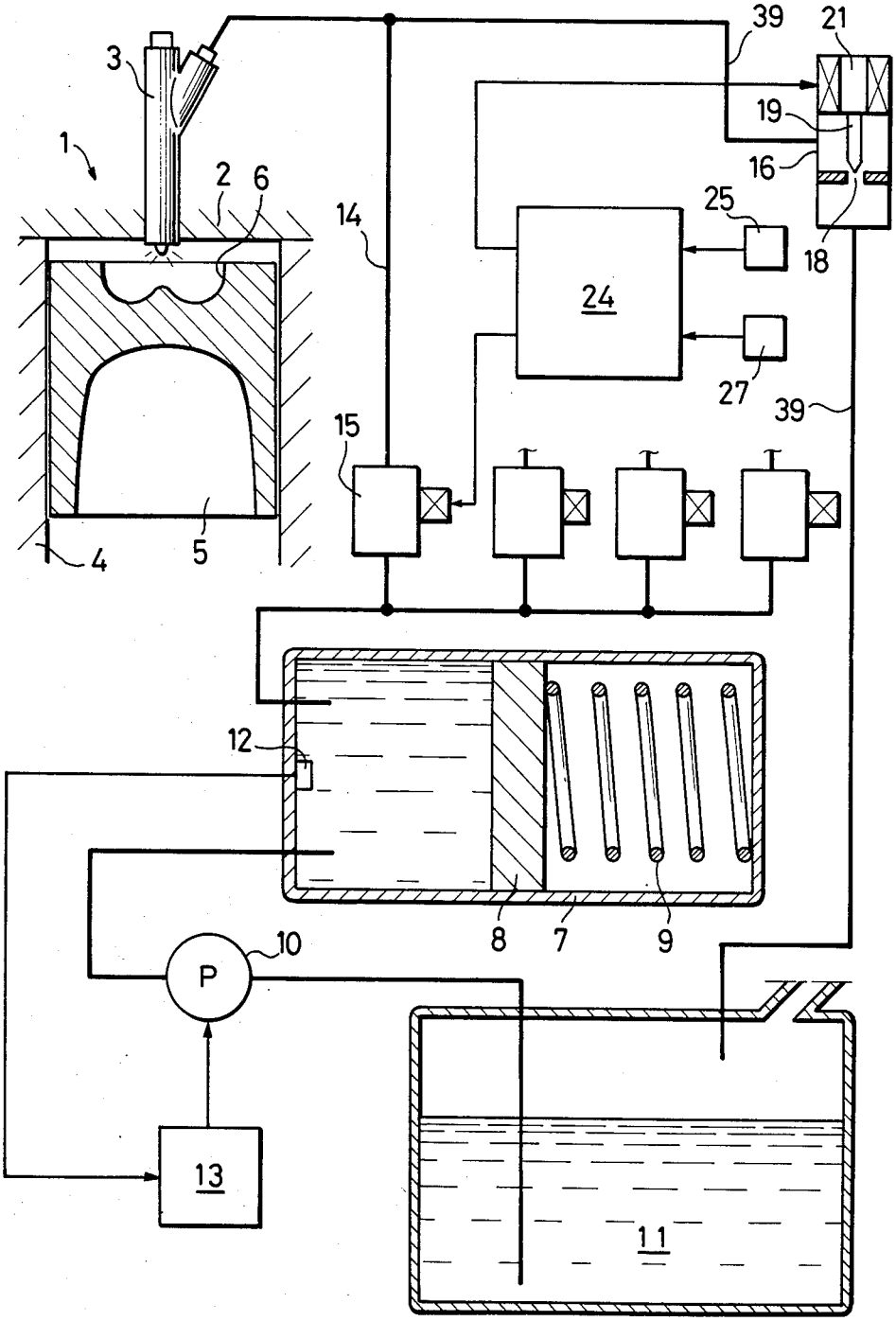
FIG. 9 is a block diagram of a fuel injection apparatus according to a fourth embodiment of this invention.

The fourth embodiment of this invention will be described with reference to FIG. 9. The salient feature of this invention is that the quantity of fuel injected at one time is controlled by a leakage control valve 16 which has the same structure as that of the throttle valve 16 in the first embodiment. The throttle valve 16 has a stepping motor 21 to displace the needle 19 which controls the effective area of the throttle opening 18 to control the quantity of the fuel that leaks through this valve 16. The leakage control valve 16 is connected to the leakage pipe 39 which diverges, from the fuel pipe 14 and the top end of which goes into the fuel tank 11.

When the magnetic timing vlave 15 is opened, some of the fuel from the accumulator 7 is supplied to the injecting nozzle 3 and the remaining portion of the fuel leaks through the leakage pipe 39 and the leakage valve 16. Assuming that the total quantity of fuel which goes through the magnetic valve 15 is Q, the quantity of the fuel supplied to the injecting nozzle 3 is $Q_1$, and the quantity of fuel leaking through the leakage valve 13 is $Q_2$, the following equation is obtained:

$$Q=Q_1+Q_2$$

As the pressure of the fuel in the accumulator 7 is held substantially constant, the total quantity Q of the fuel which goes through the magnetic valve 15 is also substantially constant. Accordingly, the quantity $Q_1$ of fuel injected by the nozzle 3 is controlled when the quantity $Q_2$ of fuel leaked through the leakage valve 16 is changed. Namely, the leakage valve 16 controls the quantity of the fuel injected by the nozzle 3. This calculation is performed by the micro processor 24 in response to the detections of the revolution detecting sensor 25 and the load sensor or accel sensor 27.

As mentioned above, according to this embodiment the quantity control operation is psrformed by the leakage control valve 16 which is connected in parallel to the injecting nozzle 3 in relative connection to the accumulator 7, and for this reason the fuel pressure created by the accumulator 7 is directly applied to the injecting nozzle 3. That is, the control vlave 16 is not connected to the fuel pipe 14 between the accumulator 7 and the fuel injection nozzle 3, and the control valve 16 does not decrease the pressure of the fuel supplied to the injecting nozzle 3. Accordingly, the proper injection is performed and the nozzle 3 sprays the fuel mist, even though the quantity of fuel supplied to the nozzle 3 is minimized to establish the desirable combustion.

Figure 10:
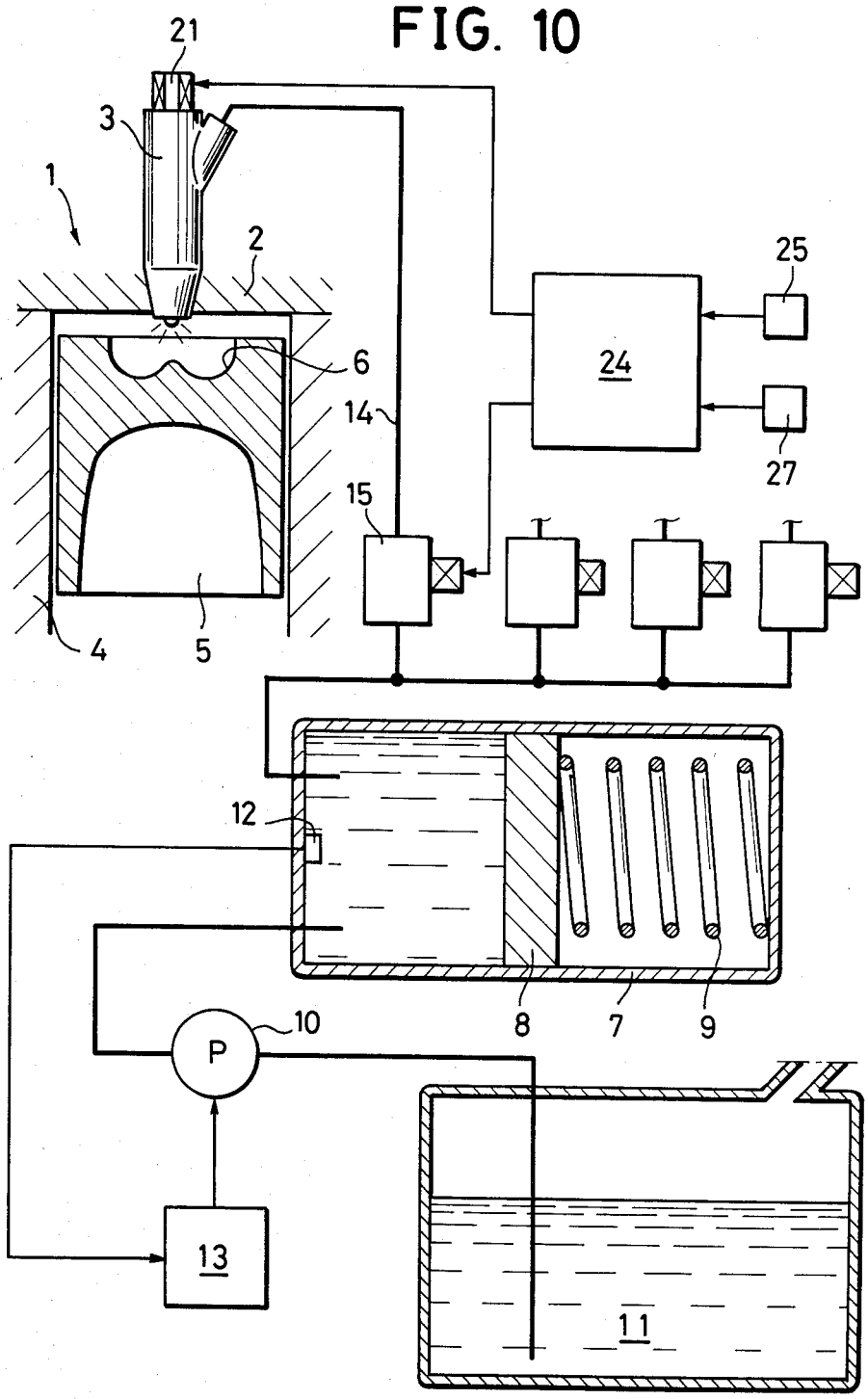
FIG. 10 is a block diagram of a fuel injection apparatus according to a fifth embodiment of this invention.
Figure 11:
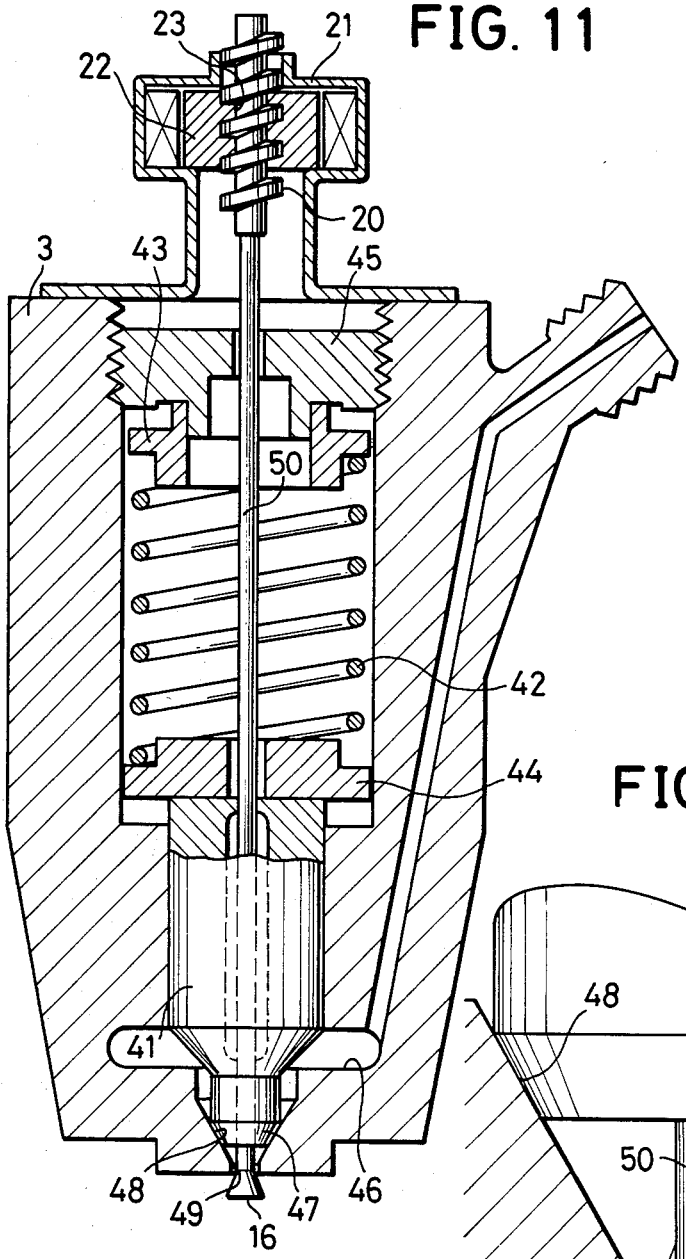
FIG. 11 is a cross section of the injecting nozzle of the fuel injection apparatus shown in FIG. 10.
Figure 12:
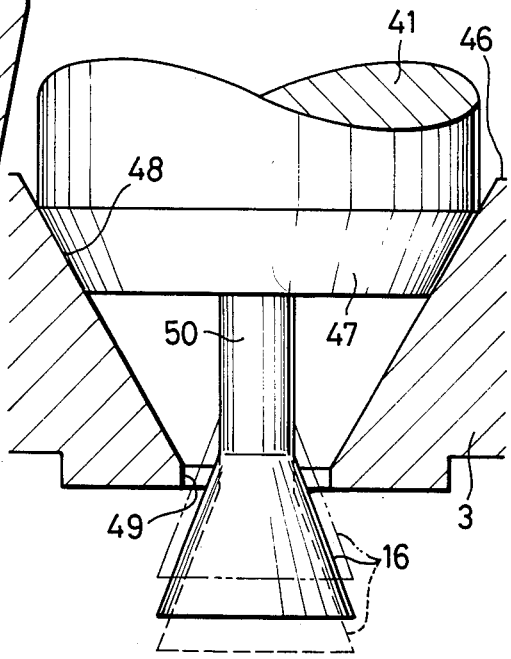
FIG. 12 is an enlarged cross section of the injecting nozzle shown in FIG. 11.

Referring to FIG. 10, FIG. 11 and FIG. 12, there will next be described a fifth embodiment of this embodiment, wherein the quantity control valve 16 is coupled to the injecting nozzle 3. The nozzle 3 comprises a body with a recess therein, and the recess receives a nozzle needle 41, which is put in place in turn by a coil spring 42. Both ends of the coil spring 42 are received by respective spring seats 43 and 44, and the nozzle needle 41 is pushed by the spring 42 through the spring seat 44. The upper spring seat 43 is supported by the adjusting screw 45 which controls the opeing pressure of this nozzle 3.

The fuel pressure is applied to the nozzle needle 41 in the irrigation recess 46 formed in the nozzle body 3. When the fuel pressure is stronger than the force of the spring 42, the nozzle needle displaces upwards to separate the valve portion 47 from the valve seat 48 and open the injecting hole 49 formed at the top of the nozzle 3, and the hole 49 receives the quantity control valve 16 to control an effective area of the hole 49. The valve 16 is connected to a rod 50 which goes through the nozzle needle 3 and the top end of which is connected with a screw 20 to the stepping motor 21. The stepping motor 21 has the same structure as that in the first embodiment. Namely, the screw 20 is threaded with the femal screw 23 of the rotor 22 and the screw 20 is prevented from rotation.

Upon operation, the micro processor 24 drives the stepping motor 21 through the drive circuit (not shown) to rotate the rotor 22. As the screw 20 is engaged with the female screw 23 of the rotor 22, the screw 20 moves axially in accordance with the rotation of the rotor 22. Therefore, the control valve 16 connected to the screw 20 through the rod 50 displaces axially and thus changes the effective area of the injecting hole 49 as shown in FIG. 12. When the control valve 16 displaces upwards, the effective area of the injecting hole 49 is reduced. In contrast, when the valve 16 displaces downwards, the area enlarges. This operation makes it possible to control the quantity of fuel injected at one time. Furthermore, the fuel pressure applied by the accumulator 7 is directly supplied to the injecting nozzle 3, and hence very high pressure injection is maintained even if the nozzle hole 49 is throttled. Therefore, this apparatus is an ideal fuel injection system for Diesel engines.

Having described specific embodiments of this invention with reference to the accompanying drawings, it must be understood that the invention is not limited to these precise embodiments. Various changes and modifications may be effected by one skilled in the art without departing from the scope or spirit of the invention as defined in the appended claims.

What is claimed is:

1. A fuel injection apparatus wherein fuel under pressure is supplied to an injecting nozzle for injecting a mist of fuel, said injection apparatus comprising:

(a) an accumulator for holding the fuel under pressure;

(b) a timing control valve for controlling the timing of the supply of fuel from said accumulator to said injecting nozzle;

(c) a quantity control valve for controlling the quantity of fuel injected by said injecting nozzle at one time, said quantity control valve being coupled to its respective injecting nozzle, and said quantity control valve controlling the effective area of the injecting hole of said injecting nozzle; and (d) an electric control means for controlling said timing control valve and said quantity control valve in response to the number of revolutions and engine load.

2. A fuel injection apparatus wherein fuel under pressure is supplied to an injecting nozzle for injecting a mist of fuel, said injection apparatus comprising:

(a) an accumulator for holding the fuel under pressure; said accumulator including a latch means for releasing the pressure on the fuel therein to prevent leakage of fuel when the engine stops;

(b) a timing control valve for controlling the timing of the supply of fuel from said accumulator to said injecting nozzle;

(c) a quantity control valve for controlling the quantity of fuel injected by said injecting nozzle at one time, and (d) an electric control means for controlling said timing control valve and said quantity control valve in response to the number of revolutions and engine load.

3. A fuel injection apparatus according to claim 1 wherein said electric control means comprises a micro processor for calculating and determining the injection pattern in response to the number of engine revolutions and engine load, said micro processor controlling said timing control valve to obtain said time and duration, and said micro processor controlling said quantity control valve to determine said quantity of fuel injected.

4. A fuel injection apparatus according to claim 1, wherein said timing control valve is comprised of a magnetic valve.

5. A fuel injection apparatus according to claim 2, wherein said quantity control valve is comprised of a throttle valve, the effective area of the throttle opening of which is adjustable to allow control over the quantity of fuel.

6. A fuel injection apparatus according to claim 2, wherein said apparatus further comprises another pair consisting of a timing control valve and a quantity control valve to accomplish a pilot injection.

7. A fuel injection apparatus according to claim 1, wherein said timing control valve is coupled to a respective injecting nozzle.

8. A fuel injection apparatus according to claim 2, wherein said quantity control valve is connected with all the injecting nozzles and is commonly used for all the injecting nozzles.

9. A fuel injection apparatus according to claim 2, wherein said quantity control valve is comprised of a leakage control valve and said leakage control valve is connected in parallel to said injecting nozzle in relative connection to said accumulator.

* * * * *